US006425729B1

(12) United States Patent
Coutant

(10) Patent No.: US 6,425,729 B1
(45) Date of Patent: Jul. 30, 2002

(54) ARRANGEMENT FOR CONTROLLING A WORK MACHINE

(75) Inventor: Alan R. Coutant, Leicestershire (GB)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/535,355

(22) Filed: Mar. 24, 2000

(51) Int. Cl.[7] ..... E02F 3/00

(52) U.S. Cl. ..... 414/685; 74/471 XY; 74/523; 414/718

(58) Field of Search ..... 414/4, 5, 6, 729, 414/685, 718, 728; 212/304; 74/471 XY, 523; 200/61.86

(56) References Cited

U.S. PATENT DOCUMENTS

| | | | | |
|---|---|---|---|---|
| 3,280,991 A | * | 10/1966 | Melton et al. | 414/5 |
| 4,574,651 A | | 3/1986 | Nordstrom | |
| 5,015,147 A | * | 5/1991 | Taylor et al. | 212/304 X |
| 5,042,314 A | | 8/1991 | Rytter et al. | |
| 5,112,184 A | | 5/1992 | Tapper et al. | |
| 5,142,931 A | | 9/1992 | Menahem | |
| 5,232,057 A | | 8/1993 | Renard | |
| 5,285,861 A | | 2/1994 | Nakamura | |
| 5,490,755 A | * | 2/1996 | Billotte | 414/729 X |
| 5,574,642 A | | 11/1996 | Cooper | |
| 5,591,082 A | | 1/1997 | Jensen et al. | |
| 5,887,669 A | | 3/1999 | Ostler et al. | |

FOREIGN PATENT DOCUMENTS

| | | |
|---|---|---|
| EP | 0 712 062 | 5/1996 |
| GB | 2 327 077 | 1/1999 |
| WO | WO 99/05060 | 2/1999 |

* cited by examiner

*Primary Examiner*—Donald W. Underwood
(74) *Attorney, Agent, or Firm*—Bradford G. Addison; Maginot, Moore & Bowman

(57) ABSTRACT

An arrangement for controlling a work machine which includes (i) a boom and (ii) a coupling mechanism secured to an end of the boom is disclosed. The arrangement includes a first control assembly having (i) a first gripping portion and (ii) a first actuator secured to the first gripping portion so that the first actuator can move relative to the first gripping portion. The first control assembly is configured to be operatively coupled to the boom and the coupling mechanism of the work machine such that (i) movement of the first gripping portion in (A) a first direction causes the boom to execute a first movement function, (B) a second direction causes the boom to execute a second movement function, (C) a third direction causes the coupling mechanism to move relative to the boom in a first direction, and (D) a fourth direction causes the coupling mechanism to move relative to the boom in a second direction and (ii) movement of the first actuator relative to the first gripping portion in (A) a first direction causes the boom to execute a third movement function and (B) a second direction causes the boom to execute a fourth movement function.

18 Claims, 5 Drawing Sheets

Fig. 1
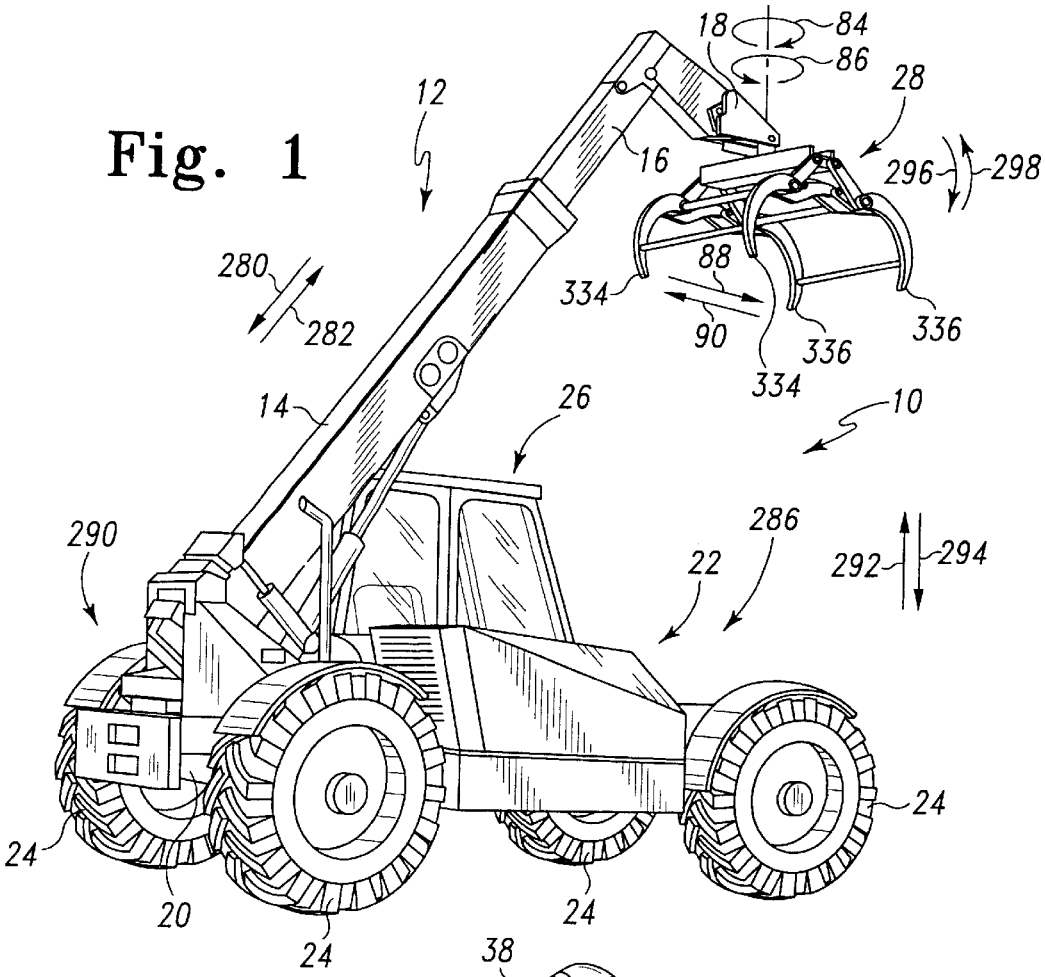
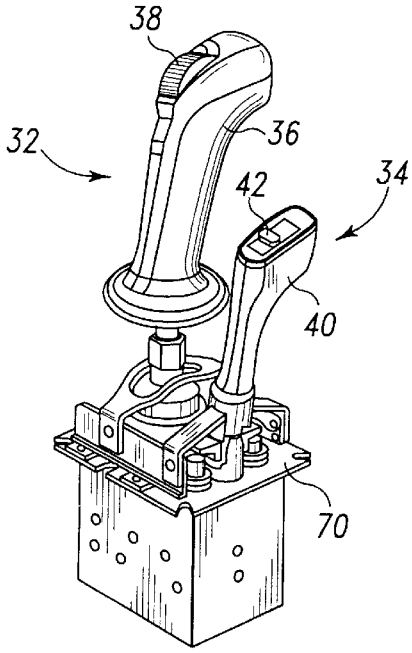
Fig. 2

ARRANGEMENT FOR CONTROLLING A WORK MACHINE

TECHNICAL FIELD OF THE INVENTION

The present invention relates generally to work machines, and more particularly to an arrangement for a controlling a work machine.

BACKGROUND OF THE INVENTION

A work machine, such as a telescopic handler, generally includes several hydraulically actuated components for performing various work functions. For example, a telescopic handler will typically include an implement attached to an end of a telescoping boom via a coupling mechanism. Telescopic handles can also include a pair of outriggers for stabilizing the work machine when moving material with the telescoping boom.

Heretofore, the various components of the telescopic handler have been controlled by an operator positioned within a cab assembly of the work machine. In particular, a plurality of buttons and/or switches are located within the cab assembly and the operator actuates one or more of these buttons and/or switches in order to control the various components. One drawback to the above described arrangement is that having a plurality of separate buttons and/or switches to control the various work machine components is not ergonomically correct and thus makes the operation of the work machine inconvenient for the operator. Moreover, this inconvenience can contribute to the operator becoming excessively fatigued during operation the work machine. Another drawback of the above described arrangement is that the mere pressing of a button or the flip of a switch does not provide the operator with proportional control over the component being manipulated. This lack of proportional control can decrease the operator's ability to precisely control the movements of the work machine components during work function performance. Yet another drawback to the above described arrangement is that providing a plurality of separate buttons and/or switches to control the various work machine components increases the mechanical complexity of the work machine, and thus increases its manufacturing cost.

What is needed therefore is an arrangement for controlling work machine components which overcomes the above-mentioned drawbacks.

DISCLOSURE OF THE INVENTION

In accordance with a first embodiment of the present invention, there is provided an arrangement for controlling a work machine which includes (i) a boom and (ii) a coupling mechanism secured to an end of the boom. The arrangement includes a first control assembly having (i) a first gripping portion and (ii) a first actuator secured to the first gripping portion so that the first actuator can move relative to the first gripping portion. The first control assembly is configured to be operatively coupled to the boom and the coupling mechanism of the work machine such that (i) movement of the first gripping portion in (A) a first direction causes the boom to execute a first movement function, (B) a second direction causes the boom to execute a second movement function, (C) a third direction causes the coupling mechanism to move relative to the boom in a first direction, and (D) a fourth direction causes the coupling mechanism to move relative to the boom in a second direction and (ii) movement of the first actuator relative to the first gripping portion in (A) a first direction causes the boom to execute a third movement function and (B) a second direction causes the boom to execute a fourth movement function.

In accordance with a second embodiment of the present invention, there is provided a work machine. The work machine includes a boom and a coupling mechanism secured to an end of the boom. The work machine also includes a first control assembly having (i) a first gripping portion and (ii) a first actuator secured to the first gripping portion so that the first actuator can move relative to the first gripping portion. The first control assembly is operatively coupled to the boom and the coupling mechanism such that (i) movement of the first gripping portion in (A) a first direction causes the boom to execute a first movement function, (B) a second direction causes the boom to execute a second movement function, (C) a third direction causes the coupling mechanism to move relative to the boom in a first direction, and (D) a fourth direction causes the coupling mechanism to move relative to the boom in a second direction and (ii) movement of the first actuator relative to the first gripping portion in (A) a first direction causes the boom to execute a third movement function and (B) a second direction causes the boom to execute a fourth movement function.

In accordance with a third embodiment of the present invention, there is provided an arrangement for controlling a work machine having a first work component. The arrangement includes a first control assembly having (i) a first gripping portion and (ii) an actuator secured to the first gripping portion so that the actuator can move relative to the first gripping portion. The first control assembly is configured to be operatively coupled to the first work component of the work machine such that (i) movement of the first gripping portion in (A) a first direction causes the first work component to move in a first work component direction in a manner which is directly proportional to the magnitude the first gripping portion is moved in the first direction, (B) a second direction causes the first work component to move in a second work component direction in a manner which is directly proportional to the magnitude the first gripping portion is moved in the second direction and (ii) movement of the first actuator relative to the first gripping portion in (A) a first direction causes the first work component to move in a third work component direction in a manner which is directly proportional to the magnitude the actuator is moved in the first direction and (B) a second direction causes the work component to move in a fourth work component direction in a manner which is directly proportional to the magnitude the actuator is moved in the fourth direction.

BRIEF DESCRIPTION OF THE DRAWINGS

FIG. 1 is a perspective view of a work machine which incorporates the features of the present invention therein;

FIG. 2 is a perspective view of a main control assembly and an auxiliary control assembly of the work machine of FIG. 1;

BEST MODE FOR CARRYING OUT THE INVENTION

Figure 3:
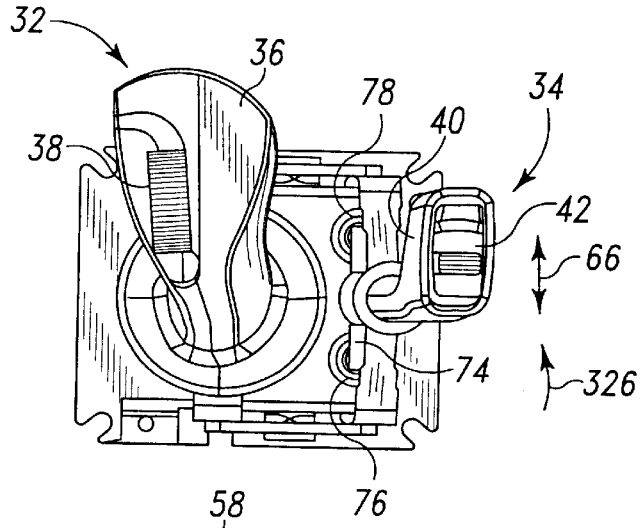
FIG. 3 is a top view of the main control assembly and the auxiliary control assembly of FIG. 2.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1 there is shown a work machine 10 such as a telescopic handler. Work machine 10 includes a frame 20 having a front portion 286 and a rear portion 290. As more clearly shown in FIG. 7, work machine 10 also includes a stabilizing assembly 288 mounted on front portion 286 of frame 20. Work machine 10 also has a number of wheels 24 rotatably mounted onto frame 20 (see FIG. 1). Work machine 10 further includes a cab assembly 26 and an engine assembly 22 mounted on frame 20. Work machine 10 also includes a boom assembly 12 pivotally mounted onto rear portion 290 of frame 20. Work machine 10 further includes a work implement 28, such as a grab implement, operatively coupled to boom assembly 12. As schematically shown in FIG. 8, work machine 10 still further includes an arrangement 30 for controlling work machine 10.

Still referring to FIG. 1, boom assembly 12 includes boom members 14, 16, and 18. An end of boom member 14 is pivotally mounted to rear portion 290 of frame 20 such that boom member 14, and thus boom assembly 12, can move relative to frame 20 in the directions indicated by arrows 292 and 294. Boom member 16 is slidably mounted within boom member 14 so that boom member 16 can be (i) extended out of boom member 14 in the direction indicated by arrow 282 or (ii) retracted into boom member 14 in the direction indicated by arrow 280. Boom member 18 is pivotally coupled to an end of boom member 16 such that boom member 18 can pivot relative to boom member 16 in the directions indicated by arrows 296 and 298.

Figure 7:
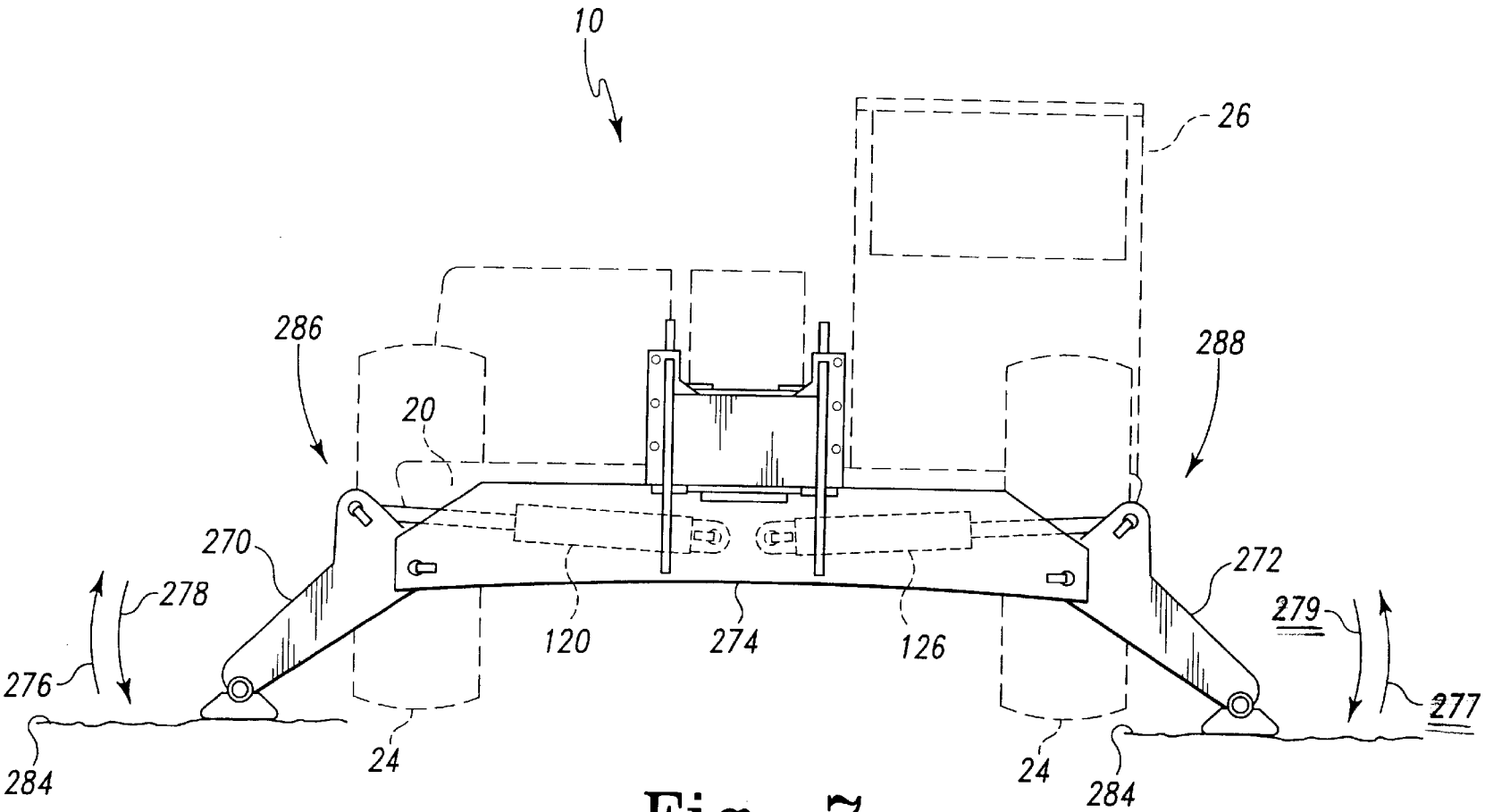
FIG. 7 is an end view of the work machine of FIG. 1 showing the stabilizing assembly thereof.

As shown in FIG. 7, stabilizing assembly 288 includes a pair of stabilizers 270 and 272 pivotally coupled to a fender 274 of work machine 10. In particular stabilizer 270 is pivotally mounted to fender 274 such that stabilizer 270 can move relative to frame 20 in the directions indicated by arrows 276 and 278. In a similar manner, stabilizer 272 is pivotally mounted to fender 274 such that stabilizer 272 can move relative to frame 20 in the directions indicated by arrows 277 and 279.

Figure 8:
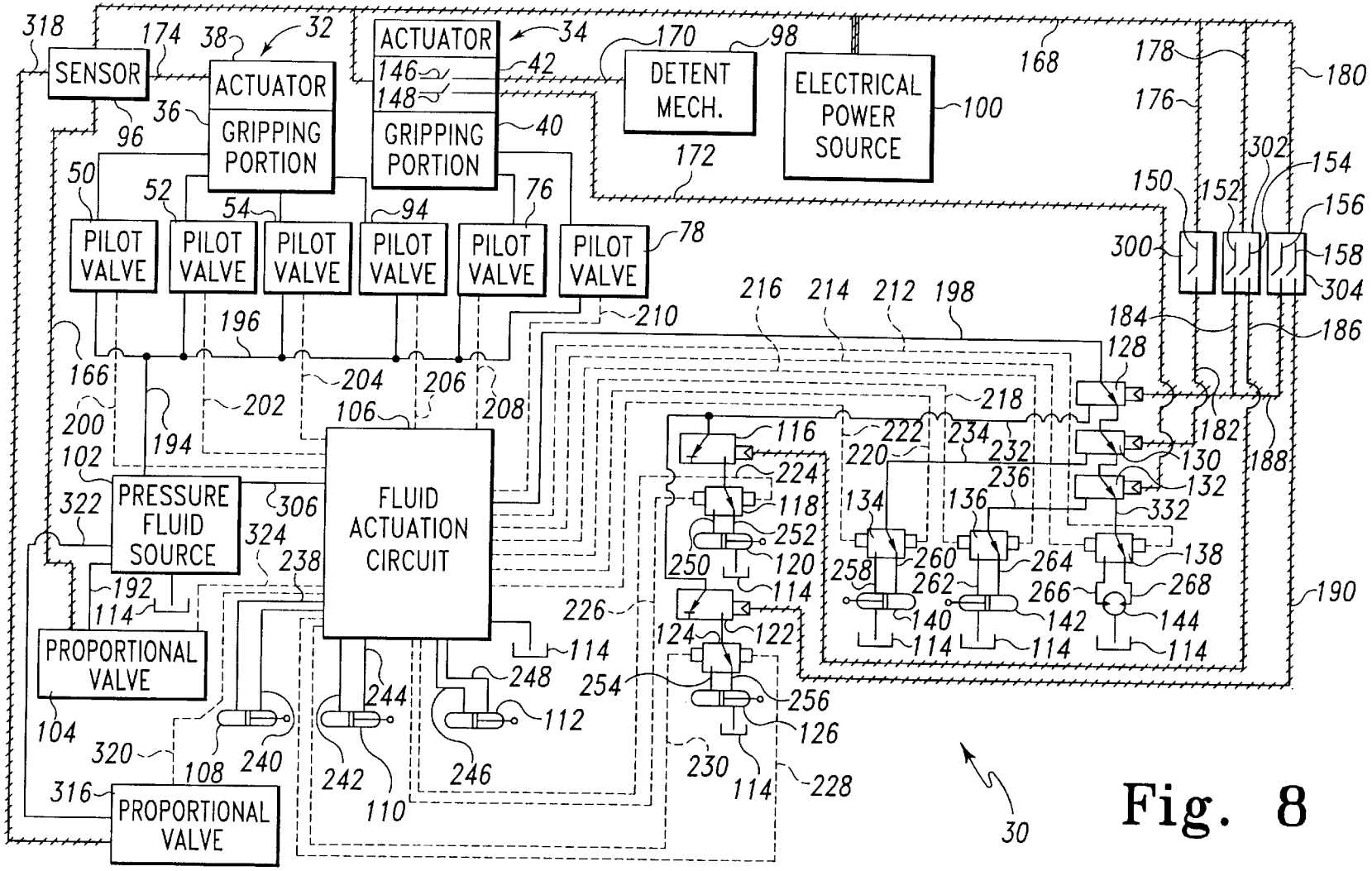
FIG. 8 is a schematic representation of the arrangement for controlling the work machine of FIG. 1.

Referring now to FIG. 8, arrangement 30 for controlling work machine 10 (hereinafter referred to as arrangement 30) includes a pressure fluid source 102, a fluid actuation circuit 106, and an electrical power source 100. Arrangement 30 also includes a main control assembly 32 (also see FIGS. 2–6), an auxiliary control assembly 34 (also see FIGS. 2–6), and a number of pilot valves 50, 52, 54, 94, 76, and 78 (also see FIGS. 5 and 6). Arrangement 30 further includes a sensor 96, a pair of proportional valves 104 and 316, and a detent mechanism 98. Arrangement 30 still further includes a number of fluid cylinders 108, 110, 112, 120, 126, 140, and 142. In addition, arrangement 30 includes a hydraulic motor 144. Arrangement 30 also includes auxiliary actuators 300, 302, and 304. Auxiliary actuator 300 includes electrical switch 150, auxiliary actuator 302 includes electrical switches 152 and 154, and auxiliary actuator 304 includes electrical switches 156 and 158. Arrangement 30 further includes a number of solenoid actuated diverter valves 116, 122, 128, 130, and 132. Arrangement 30 also includes a number of pilot actuated diverter valves 118, 124, 134, 136, and 138.

As shown in FIGS. 2–6, main control assembly 32 includes a gripping portion 36 and an actuator 38. Main control assembly 32 also includes a rod 44, a body member 46, and a plate 48. It should be understood that actuator 38 is secured to gripping portion 36 such that actuator 38 can move relative to gripping portion 36. For example, as shown more clearly in FIG. 4, actuator 38 can include a knob mounted on gripping portion 36 such that the knob can rotate relative to gripping portion 36 around an axis of rotation 60 in the directions indicated by arrows 62 and 64. It should also be understood that gripping portion 36 is contoured to fit into a hand (not shown) of an operator (not shown) of work machine 10.

An end of rod 44 is secured to gripping portion 36 while the other end of rod 44 is secured to body 46. Plate 48 is secured to body 46 such that body 46 is interposed between rod 44 and plate 48. Main control assembly 32 is secured to a pilot support member 70 with a well known parallelogram linkage 80 such that plate 48 is positioned in contact with each pilot valve 50, 52, 54, and 94. Note that pilot valve 94 is not shown in FIGS. 2–6. However, it should be appreciated that pilot valve 94 is positioned opposite to pilot valve 52 and interposed between pilot valves 50 and 54. Main control assembly 32 is also secured to pilot support member 70 with parallelogram linkage 80 such that gripping portion 36 can move relative to pilot support member 70 in the directions indicated by arrows 56 and 58 (see FIGS. 4 and 5).

Still referring to FIGS. 2–6, auxiliary control assembly 34 includes a gripping portion 40 and an actuator 42. It should be understood that actuator 42 is secured to gripping portion 40 so that actuator 42 can move relative to gripping portion 40. For example, actuator 42 can include a three position switch which can be moved relative to gripping portion 40 in the directions indicated by arrow 66 as shown in FIG. 3. Auxiliary control assembly 34 also includes a rod 72 having an end secured to gripping portion 40. The other end of rod 72 is mechanically coupled to a lever 74. Auxiliary control assembly 34 further includes a magnetic detent mechanism 98 secured to rod 72 such that magnetic detent mechanism 98 is interposed between lever 74 and gripping portion 40.

Auxiliary control assembly 34 is secured to pilot support member 70 with parallelogram linkage 80 such that lever 74 is positioned in contact with each pilot valve 76 and 78. Auxiliary control assembly 34 is also secured to pilot support member 70 with parallelogram linkage 80 such that gripping portion 40 can move relative to pilot support member 70 in the directions indicated by arrow 68.

It should be appreciated that having both main control assembly 32 and auxiliary control assembly 34 attached to pilot support member 70 with parallelogram linkage 80 results in main control assembly 32 and auxiliary control assembly 34 being mechanically coupled to one another. In particular, mechanically coupling the aforementioned control assemblies (i.e. control assemblies 32 and 34) in the above described manner results in gripping portion 40 being moved in the directions indicated by arrow 58 (see FIG. 4), when gripping portion 36 is moved in the directions indicated by arrow 58. In the alternative, moving gripping portion 40 in the directions indicated by arrow 58 also causes gripping portion 36 to move in the directions indicated by arrow 58. However, it should be understood that gripping portion 36 and gripping portion 40 can be moved independent of one another when moved in the directions indicated by arrows 56 and 68 (see FIGS. 5 and 6), respectively.

Figure 4:
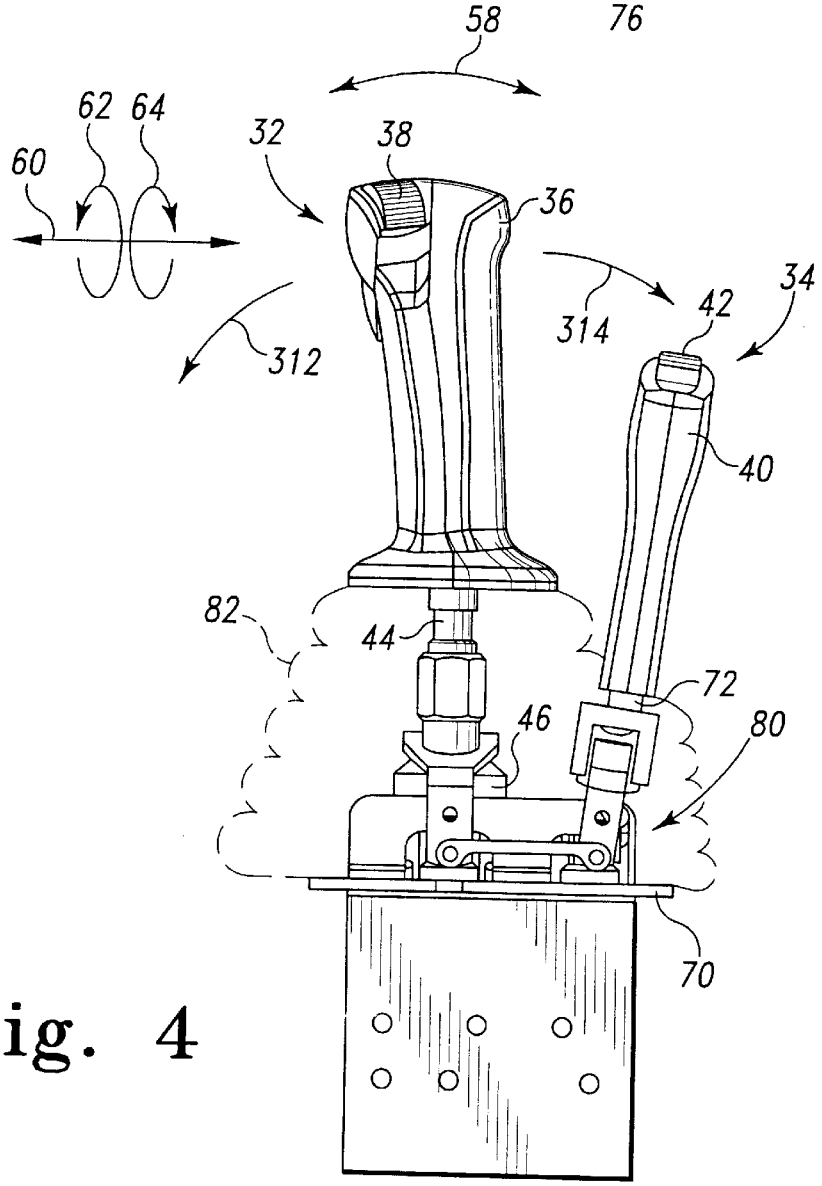
FIG. 4 is a rear view of the main control assembly and the auxiliary control assembly of FIG. 2.
Figure 5:
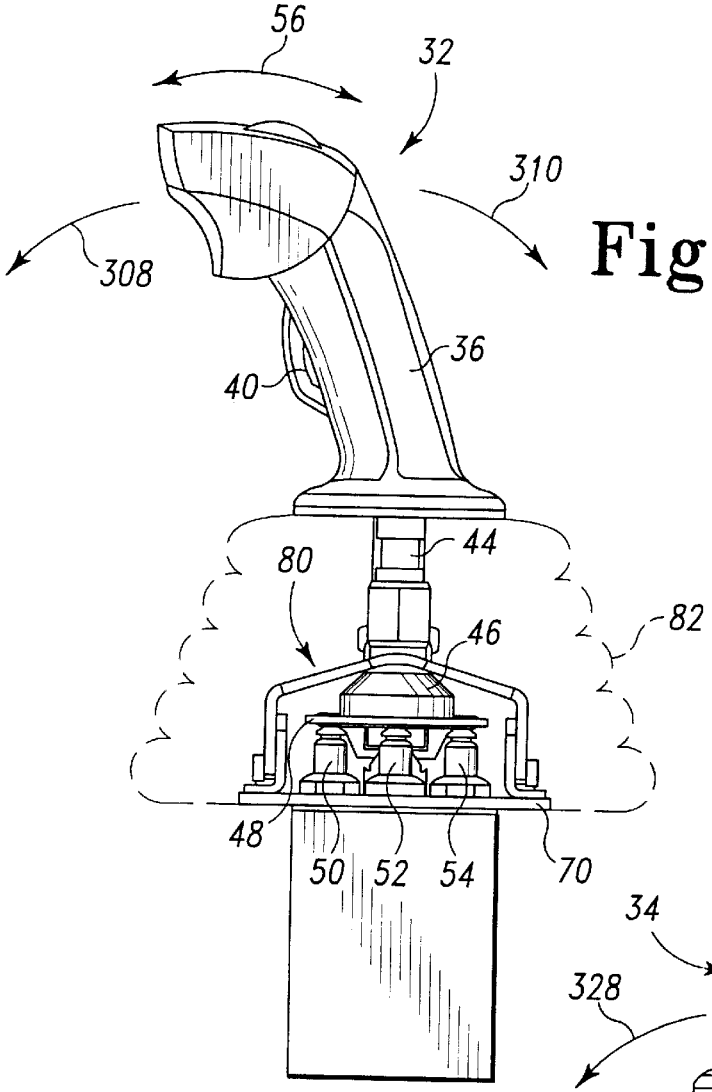
FIG. 5 is a side elevational view of the main control assembly and the auxiliary control assembly of FIG. 2.
Figure 6:
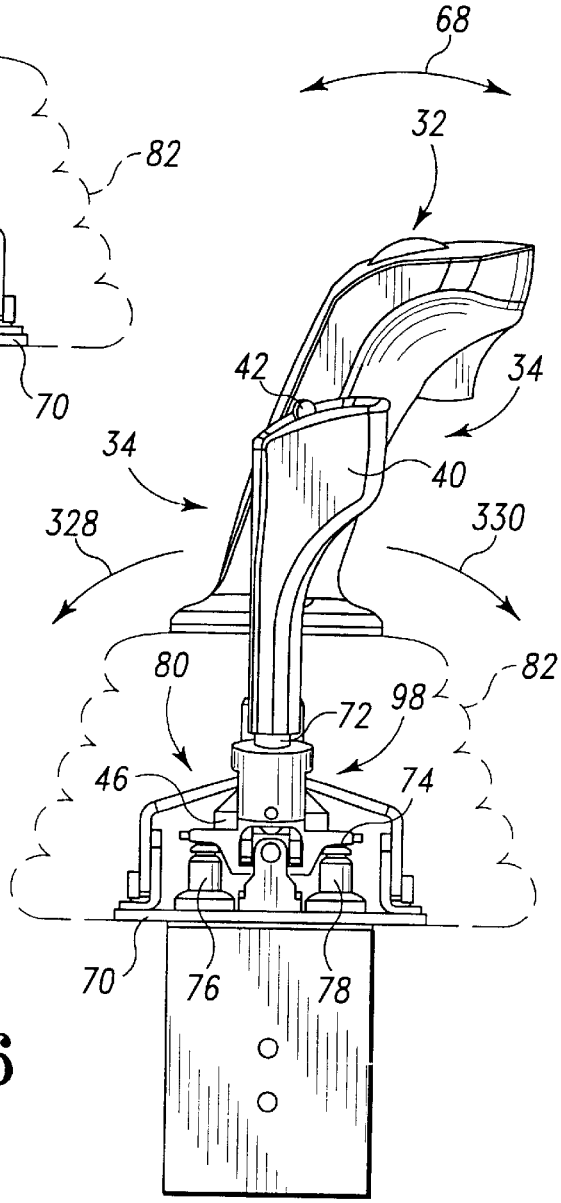
FIG. 6 is another side elevational view of the main control assembly and the auxiliary control assembly of FIG. 2.

As shown in phantom in FIGS. 4–6, a rubber boot 82 is disposed around a portion of each of main control assembly 32 and auxiliary control assembly 34 for protection thereof.

Referring back to FIG. 8, engine assembly 22 (see FIG. 1) drives pressure fluid source 102 such that pressure fluid source 102 withdraws fluid from tank 114 and provides an operational fluid pressure to fluid actuation circuit 106 via hydraulic line 306. It should be understood that fluid actuation circuit 106 is a well known conventional fluid circuit containing a number of valves and components and will not be discussed in detail herein for clarity of description. Pressure fluid source 102 also provides an operational fluid pressure to proportional valves 104 and 316 via hydraulic lines 192 and 322, respectively. Pressure fluid source 102 further provides an operational fluid pressure to each pilot valve 50, 52, 54, 94, 76, and 78 via hydraulic lines 194 and 196.

Now referring to FIGS. 5 and 8, moving gripping portion 36 of main control assembly 32 relative to pilot support member 70 in the direction indicated by arrow 308 causes plate 48 to be urged against pilot valve 50. Urging plate 48 against pilot valve 50 results in pilot valve 50 opening such that a pilot pressure is provided from pressure fluid source 102 to fluid actuation circuit 106 via pilot line 200 (see FIG. 8). Providing a pilot pressure to fluid actuation circuit 106 via pilot line 200 causes an operational fluid pressure to be supplied from pressure source 102 to the rod side of fluid cylinder 108 via hydraulic line 240. Providing an operational fluid pressure to cylinder 108 via hydraulic line 240 results in the retraction of the rod of fluid cylinder 108. It should be appreciated that fluid cylinder 108 is mechanically coupled to boom assembly 12 in a well known manner such that the retraction of the rod of fluid cylinder 108 causes boom assembly 12 to move relative to frame 20 in the direction indicated by arrow 294 (see FIG. 1).

Still referring to FIGS. 5 and 8, moving gripping portion 36 of main control assembly 32 relative to pilot support member 70 in the direction indicated by arrow 310 causes plate 48 to be urged against pilot valve 54. Urging plate 48 against pilot valve 54 results in pilot valve 54 opening such that a pilot pressure is provided from pressure fluid source 102 to fluid actuation circuit 106 via pilot line 204. Providing a pilot pressure to fluid actuation circuit 106 via pilot line 204 causes an operational fluid pressure to be supplied from pressure source 102 to the piston side of fluid cylinder 108 via hydraulic line 238. Providing an operational fluid pressure to cylinder 108 via hydraulic line 238 results in the extension of the rod of fluid cylinder 108. It should be appreciated that the extension of the rod of fluid cylinder 108 causes boom assembly 12 to move relative to frame 20 in the direction indicated by arrow 292 (see FIG. 1).

Referring now to FIGS. 4 and 8, moving gripping portion 36 of main control assembly 32 relative to pilot support member 70 in the direction indicated by arrow 312 causes plate 48 to be urged against pilot valve 52 (see FIG. 5). Urging plate 48 against pilot valve 52 results in pilot valve 50 opening such that a pilot pressure is provided from pressure fluid source 102 to fluid actuation circuit 106 via pilot line 202. Providing a pilot pressure to fluid actuation circuit 106 via pilot line 202 causes an operational fluid pressure to be supplied from pressure source 102 to the rod side of fluid cylinder 110 via hydraulic line 244. Providing an operational fluid pressure to cylinder 110 via hydraulic line 244 results in the retraction of the rod of fluid cylinder 110. It should be appreciated that fluid cylinder 110 is mechanically coupled to boom member 16 and boom member 18 in a well known manner such that the retraction of the rod of fluid cylinder 110 causes boom member 18 to pivot relative to boom member 16 in the direction indicated by arrow 298 (see FIG. 1).

Still referring now to FIGS. 4 and 8, moving gripping portion 36 of main control assembly 32 relative to pilot support member 70 in the direction indicated by arrow 314 causes plate 48 to be urged against pilot valve 94 (see FIG. 8). Urging plate 48 against pilot valve 94 results in pilot valve 94 opening such that a pilot pressure is provided from pressure fluid source 102 to fluid actuation circuit 106 via pilot line 206. Providing a pilot pressure to fluid actuation circuit 106 via pilot line 206 causes an operational fluid pressure to be supplied from pressure source 102 to the piston side of fluid cylinder 110 via hydraulic line 242. Providing an operational fluid pressure to cylinder 110 via hydraulic line 242 results in the extension of the rod of fluid cylinder 110. Extending the rod of fluid cylinder 110 causes boom member 18 to pivot relative to boom member 16 in the direction indicated by arrow 296 (see FIG. 1).

As shown in FIG. 8, actuator 38 is electrically coupled to sensor 96 via electrical line 174, and sensor 96 is electrically coupled to electrical power source 100 and proportional valve 104 via electrical lines 168 and 166, respectively. Sensor 96 is also electrically coupled to proportional valve 316 via electrical line 318.

As previously discussed actuator 38 can rotate relative to gripping portion 36 in the directions indicated by arrows 62 and 64 (see FIG. 4). Sensor 96 detects when actuator 38 is rotated relative to gripping portion 36 in the direction indicated by arrow 64 in a well known manner. When sensor 96 detects such rotation (i.e. rotation in the direction indicated by arrow 64) sensor 96 generates a control signal which is received by proportional valve 104 via electrical line 166. In response to receiving the control signal, proportional valve 104 opens such that a pilot pressure is provided from pressure fluid source 102 to fluid actuation circuit 106 via pilot line 324. Providing a pilot pressure to fluid actuation circuit 106 via pilot line 324 causes an operational fluid pressure to be supplied from pressure source 102 through fluid actuation circuit 106 to the piston side of fluid cylinder 112 via hydraulic line 246. Providing an operational fluid pressure to cylinder 112 via hydraulic line 246 results in the extension of the rod of fluid cylinder 112. It should be understood that fluid cylinder 112 is mechanically coupled to boom member 14 and boom member 16 in a well known manner such that the extension of the rod of fluid cylinder 112 causes boom member 16 (and thus boom member 18) to move relative to boom member 14 in the direction indicated by arrow 282 (see FIG. 1).

It should also be understood that proportional valve 104 provides a pilot pressure to s fluid actuation circuit 106 which is directly proportional to the degree actuator 38 is rotated in the direction indicated by arrow 64. As a result, the greater the rotation of actuator 38 in the direction indicated by arrow 64, the greater the time period operational fluid pressure is supplied to the piston side of fluid cylinder 112 via hydraulic line 246. Accordingly, the rod of fluid cylinder 112 is extended to a greater degree the longer the time period operational fluid pressure is supplied to the piston side of fluid cylinder 112, thereby causing boom member 16 (and thus boom member 18) to move relative to boom member 14 in the direction indicated by arrow 282 by a greater degree. In other words, the more an operator of work machine 10 rotates actuator 38 in the direction indicated by arrow 64 the greater the distance boom member 16 will extend out of boom member 14.

Sensor 96 also detects when actuator 38 is rotated relative to gripping portion 36 in the direction indicated by arrow 62. When sensor 96 detects such rotation (i.e. rotation in the direction indicated by arrow 62) sensor 96 generates a control signal which is received by proportional valve 316 via electrical line 318. In response to receiving the control signal, proportional valve 316 opens such that a pilot pressure is provided from pressure fluid source 102 to fluid actuation circuit 106 via pilot line 320. Providing a pilot pressure to fluid actuation circuit 106 via pilot line 320 causes an operational fluid pressure to be supplied from pressure source 102 through fluid actuation circuit 106 to the rod side of fluid cylinder 112 via hydraulic line 248. (It should be appreciated that any time pressure fluid source 102 supplies an operational fluid pressure to any component of work machine 10, with the exception of pilot valves 50, 52, 54, 94, 76, and 78, and proportional valves 104 and 316, the operational fluid pressure passes through fluid actuation circuit 106.) Providing an operational fluid pressure to cylinder 112 via hydraulic line 248 results in the retraction of the rod of fluid cylinder 112. The retraction of the rod of fluid cylinder 112 causes boom member 16 (and thus boom member 18) to move relative to boom member 14 in the direction indicated by arrow 280 (see FIG. 1).

It should be appreciated that proportional valve 316 functions in a substantially identical manner as discussed above in reference to proportional valve 104 such that the more an operator of work machine 10 rotates actuator 38 in the direction indicated by arrow 62 the greater the distance boom member 16 is retracted into boom member 14.

As previously discussed, actuator 42 of auxiliary control assembly 34 can be moved relative to gripping portion 40 in the directions indicated by arrow 66 (see FIG. 3). In particular, actuator 42 is movable between a first position, a second position, and a third position. For example, each of the aforementioned positions can be indicated to an operator of work machine 10 by a catch or a detent encountered when moving actuator 42 relative to gripping portion 40 in the directions indicated by arrow 66. For example, FIG. 3 shows actuator 42 in the first position, however actuator 42 can be located in the second position by moving actuator 42 in the direction indicated by arrow 326 until actuator 42 encounters a second detent. Moreover, actuator 42 can be located in the third position by further moving actuator 42 in the direction indicated by arrow 326 until actuator encounters a third detent.

Referring now to FIGS. 3, 6, and 8, moving gripping portion 40 of auxiliary control assembly 34 relative to pilot support member 70 in the direction indicated by arrow 330 causes lever 74 to be urged against pilot valve 78. Urging lever 74 against pilot valve 78 results in pilot valve 78 opening such that a pilot pressure is provided from pressure fluid source 102 to fluid actuation circuit 106 via pilot line 210. Providing a pilot pressure to fluid actuation circuit 106 via pilot line 210 causes an operational fluid pressure to be supplied from pressure source 102 to solenoid actuated diverter valve 128 via hydraulic line 198. Providing a pilot pressure to fluid actuation circuit 106 via pilot line 210 also causes a pilot pressure to be supplied from fluid actuation circuit 106 to an input of pilot actuated diverter valve 138 via pilot line 214. Supplying a pilot pressure to pilot actuated diverter valve 138 via pilot line 214 causes hydraulic motor 144 to be in fluid communication with the operational fluid pressure supplied by hydraulic line 198. It should be appreciated that when actuator 42 is located in the first position (i.e. both electrical switches 146 and 148 are open) and gripping portion 40 is manipulated in the above described manner, operational fluid pressure is supplied to hydraulic motor 144 from hydraulic line 198 via (i) solenoid diverter valves 128, 130, and 132, (ii) pilot actuated diverter valve 138, and (iii) hydraulic line 268.

It should be understood that hydraulic motor 144 is mechanically coupled to implement 28 (see FIG. 1) and boom member 18 in a well know manner such that actuation of hydraulic motor 144 causes implement 28 to rotate relative boom member 18 in the directions indicated by arrows 84 and 86. In particular, when an operational fluid pressure is supplied to hydraulic motor 144 via 268 hydraulic motor 144 is actuated so as to rotate implement 28 in the direction indicated by 84. Returning gripping portion 40 to a substantially vertical position so that lever 74 is no longer urged against pilot valve 78 results in the operational fluid pressure supplied by fluid actuation circuit 106 being shut off. Shutting off the operational fluid pressure stops the rotation of implement 28.

In a manner similar to that described above, moving gripping portion 40 of auxiliary control assembly 34 relative to pilot support member 70 in the direction indicated by arrow 328 causes lever 74 to be urged against pilot valve 76 (also see FIG. 8). Urging lever 74 against pilot valve 76 results in pilot valve 76 opening such that a pilot pressure is provided from pressure fluid source 102 to fluid actuation circuit 106 via pilot line 208. Providing a pilot pressure to fluid actuation circuit 106 via pilot line 208 causes an operational fluid pressure to be supplied from pressure source 102 to solenoid actuated diverter valve 128 via hydraulic line 198. Providing a pilot pressure to fluid actuation circuit 106 via pilot line 208 also causes a pilot pressure to be supplied from fluid actuation circuit 106 to another input of pilot actuated diverter valve 138 via pilot line 212. Supplying a pilot pressure to pilot actuated diverter valve 138 via pilot line 212 causes hydraulic motor 144 to be in fluid communication with the operational fluid pressure supplied by hydraulic line 198 via hydraulic line 266 rather than hydraulic line 268. Specifically, when actuator 42 is located in the first position and gripping portion 40 is manipulated in the above described manner, operational fluid pressure is supplied to hydraulic motor 144 from hydraulic line 198 via (i) solenoid diverter valves 128, 130, and 132, (ii) pilot actuated diverter valve 138, and (iii) hydraulic line 266.

When an operational fluid pressure is supplied to hydraulic motor 144 via hydraulic line 266 hydraulic motor 144 is actuated so as to rotate implement 28 in the direction indicated by 86. Returning gripping portion 40 to a substantially vertical position so that lever 74 is no longer urged against pilot valve 76 results in the operational fluid pressure supplied by fluid actuation circuit 106 being shut off. Shutting off the operational fluid pressure stops the rotation of implement 28.

Locating actuator 42 an the second position causes electrical switch 148 to close while keeping electrical switch 146 open. Closing electrical switch 148 results in electrical power being supplied to the solenoid actuated diverter valve 132 via electrical lines 168 and 172. Supplying electrical power to solenoid actuated diverter valve 132 causes operational fluid pressure to be diverted away from hydraulic line 332 to hydraulic line 236. When actuator 42 is in the second position, moving gripping portion 40 in the direction indicated by arrow 330 causes operational fluid pressure to be routed in the same manner as described above with the exception that the operational fluid pressure is diverted to pilot actuated diverter valve 136 via hydraulic line 236 rather than traveling to pilot actuated diverter valve 138 via hydraulic line 332.

Furthermore, moving gripping portion 40 in the direction indicated by arrow 330 (see FIG. 3) causes a pilot fluid pressure to be supplied from fluid actuation circuit 106 to an input of pilot actuated diverter valve 136 via pilot line 218. Supplying a pilot fluid pressure to an input of pilot actuated diverter valve 136 via pilot line 218 results in an operational fluid pressure being supplied to the piston side of fluid cylinder 142 via hydraulic line 264. In particular, an operational fluid pressure is supplied to the piston side of fluid cylinder 142 via (i) hydraulic line 198, (ii) solenoid actuated diverter valves 128, 130, and 132, (iii) hydraulic line 236, (iv) pilot actuated diverter valve 136, and (v) hydraulic line 264. Supplying an operational fluid pressure to the piston side of fluid cylinder 142 causes the rod of fluid cylinder 142 to extend. Fluid cylinder 142 is mechanically coupled to implement 28 such that the extension of the rod thereof causes tongs 334 and tongs 336 of implements 28 to move away from each other in the directions indicated by arrows 88 and 90.

On the other hand, when actuator 42 is located in the second position and gripping portion 40 is moved in the direction indicated by arrow 328, a pilot fluid pressure is supplied to another input of pilot actuated diverter valve 136 via pilot line 216. Supplying a pilot fluid pressure to pilot actuated diverter valve 136 via pilot line 216 causes the operational fluid pressure to be routed to the rod side of fluid cylinder 142 via hydraulic line 262. Supplying the operational fluid pressure to the rod side of fluid cylinder 142 causes the rod thereof to retract. Retracting the rod of fluid cylinder 142 results in tongs 334 and tongs 336 of implement 28 moving toward each other as indicated by arrows 88 and 90.

Locating actuator 42 in the third position causes electrical switches 148 and 146 to close. As discussed above closing electrical switch 148 results in electrical power being supplied to solenoid actuated diverter valve 132. Closing electrical switch 146 results in electrical power being supplied to detent mechanism 98 via electrical lines 168 and 170. Therefore, it should be appreciated that when actuator 42 is located in the third position, auxiliary control assembly 34 operates in an identical manner as described above when actuator 42 is located in the second position with the exception that when actuator 42 is located in the third position detent mechanism 98 is activated. When detent mechanism 98 is activated, detent mechanism maintains the position gripping portion 40 is placed in by an operator of work machine 10. For example, an operator of work machine 10 can move gripping portion 40 in the direction indicated by arrow 328 a certain distance and then release auxiliary control assembly 34 and gripping portion 40 will remain in position such that tongs 334 and 336 of implement 28 continue to be biased toward each other.

Auxiliary control assembly 34 can also be utilized in conjunction with auxiliary actuators 300, 302, and 304. As previously mentioned, auxiliary actuator 300 includes electrical switch 150, auxiliary actuator 302 includes electrical switches 152 and 154, and auxiliary actuator 304 includes electrical switches 156 and 158. Each auxiliary actuator 300, 302, and 304 is positionable between an on position and an off position. Positioning each auxiliary actuator 300, 302, and 304 between the on and the off position alters the routing of the operational fluid pressure through arrangement 30. For example, when auxiliary actuator 300 is located in the off position, electrical switch 150 is open. On the other hand, when auxiliary actuator 300 is located in the on position electrical switch 150 is in the closed position.

When electrical switch 150 is in the closed position, electrical power is supplied to solenoid actuated diverter valve 130 via electrical lines 176 and 182. Supplying electrical power to solenoid actuated diverter valve 130 results in operational fluid pressure being diverted away from away from solenoid actuated diverter valve 132 to pilot actuated diverter valve 134 via hydraulic line 234. When auxiliary actuator 300 is located in the on position as described above, and gripping portion 40 of auxiliary control assembly 34 is moved in the direction indicated by arrow 330 (see FIG. 6) a pilot pressure is supplied to an input of pilot actuated diverter valve 134 via pilot line 222. Supplying a pilot pressure to pilot actuated diverter valve 134 via pilot line 222 results in the operational fluid pressure being supplied to the piston side of fluid cylinder 140 via hydraulic line 260. Supplying operational fluid pressure to the piston side of fluid cylinder 140 causes the rod of fluid cylinder 140 to extend.

In the alternative, when auxiliary actuator 300 is located in the on position as described above, and gripping portion 40 of auxiliary control assembly 34 is moved in the direction indicated by arrow 328 (see FIG. 6) a pilot pressure is supplied to another input of pilot actuated diverter valve 134 via pilot line 220. Supplying a pilot pressure to pilot actuated diverter valve 134 via pilot line 220 results in the operational fluid pressure being supplied to the rod side of fluid cylinder 140 via hydraulic line 258. Supplying operational fluid pressure to the rod side of fluid cylinder 140 causes the rod of fluid cylinder 140 to retract.

It should be appreciated that fluid cylinder 140 is mechanically coupled to boom member 18 and implement 28 in a well known manner such that fluid cylinder 140 functions as a coupling mechanism between boom member 18 and implement 28. The coupling mechanism is positionable between a coupled position and a decoupled position. When the rod of fluid cylinder 140 is extended, the coupling mechanism is located in the coupled position and implement 28 is mechanically secured to boom member 18. On the other hand, when the rod of fluid cylinder 140 is retracted, the coupling mechanism is located in the decoupled position and implement 28 can be removed from boom member 18.

Note that more than one fluid cylinder can be utilized in the aforementioned coupling mechanism and each fluid cylinder is controlled in an identical manner as described above for fluid cylinder 140. For example, if two fluid cylinders are employed in the coupling mechanism then the rod of each fluid cylinder will be extended when gripping portion 40 is moved in the direction indicated by arrow 330 of FIG. 6 so as to place the coupling mechanism in the coupled position. In a similar manner, the rod of each fluid cylinder will be retracted when gripping portion 40 is moved in the direction indicated by arrow 328 of FIG. 6 so as to place the coupling mechanism in the decoupled position.

Referring now to FIGS. 6, 7, and 8, auxiliary actuators 302 and 304 are used in conjunction with auxiliary control assembly 34 to control stabilizing assembly 288 of work machine 10. Specifically, when auxiliary actuator 302 is placed in the on position, electrical switches 152 and 154 are placed in the closed position. Placing electrical switches 152 and 154 in the closed position results in electrical power being supplied to (i) solenoid actuated diverter valve 128 via electrical lines 178, 184, and 188 and (ii) solenoid actuated diverter valve 116 via electrical lines 178 and 186. Supplying electrical power to solenoid actuated diverter valve 128 results in the operational fluid pressure supplied through hydraulic line 198 being diverted away from solenoid actuated diverter valve 130 to solenoid actuated diverter valve 116 via hydraulic line 232. Supplying electrical power to solenoid actuated diverter valve 116 results in the operational fluid pressure being supplied to pilot actuated diverter valve 118.

When gripping portion 40 of auxiliary control assembly 34 is moved in the direction indicated by arrow 328 a pilot pressure is supplied to an input of pilot actuated diverter valve 118 via pilot 226. Supplying a pilot pressure to pilot actuated diverter valve 118 via pilot line 226 results in operational fluid pressure being supplied to the rod side of fluid cylinder 120 via hydraulic line 252. Supplying operational fluid pressure to the rod side of fluid cylinder 120 results in the rod of fluid cylinder 120 retracting. It should be understood that fluid cylinder 120 is mechanically coupled to frame 20 and stabilizer 270 in a well known manner so that the retraction of the rod causes stabilizer to move away from ground 284 in the direction indicated by arrow 276 (see FIG. 7).

Alternatively, when auxiliary actuator 302 is located in the on position and gripping portion 40 is moved in the direction indicated by 330 a pilot pressure is supplied to another input of pilot actuated diverter valve 118 via pilot line 224. Supplying a pilot pressure to pilot actuated diverter valve 118 via pilot line 224 results in operational fluid pressure being supplied to the piston side of fluid cylinder 120 via hydraulic line 250. Supplying operational fluid pressure to the piston side of fluid cylinder 120 results in the rod of fluid cylinder 120 extending. Extending the rod of fluid cylinder 120 causes stabilizer 270 to move toward ground 284 in the direction indicated by arrow 278 (see FIG. 7).

Auxiliary actuator 304 functions to control stabilizing assembly 288 in a similar way as described above for auxiliary actuator 302. Specifically, when auxiliary actuator 304 is placed in the on position, electrical switches 156 and 158 are placed in the closed position. Placing electrical switches 156 and 158 in the closed position results in electrical power being supplied to (i) solenoid actuated diverter valve 128 via electrical lines 180 and 188 and (ii) solenoid actuated diverter valve 122 via electrical lines 180 and 190. Supplying electrical power to solenoid actuated diverter valve 128 results in the operational fluid pressure supplied through hydraulic line 198 being diverted away from solenoid actuated diverter valve 130 to solenoid actuated diverter valve 122 via hydraulic line 232. Supplying electrical power to solenoid actuated diverter valve 122 results in the operational fluid pressure being supplied to pilot actuated diverter valve 124.

When gripping portion 40 of auxiliary control assembly 34 is moved in the direction indicated by arrow 328 a pilot pressure is supplied to an input of pilot actuated diverter valve 124 via pilot 230. Supplying a pilot pressure to pilot actuated diverter valve 124 via pilot line 230 results in operational fluid pressure being supplied to the rod side of fluid cylinder 126 via hydraulic line 256. Supplying operational fluid pressure to the rod side of fluid cylinder 126 results in the rod of fluid cylinder 126 retracting. It should be understood that similar to fluid cylinder 120, fluid cylinder 126 is mechanically coupled to frame 20 and stabilizer 272 in a well known manner so that the retraction of the rod causes stabilizer 272 to move away from ground 284 in the direction indicated by arrow 277 (see FIG. 7).

Alternatively, when auxiliary actuator 302 is located in the on position and gripping portion 40 is moved in the direction indicated by 330 a pilot pressure is supplied to another input of pilot actuated diverter valve 124 via pilot line 228. Supplying a pilot pressure to pilot actuated diverter valve 124 via pilot line 228 results in operational fluid pressure being supplied to the piston side of fluid cylinder 126 via hydraulic line 254. Supplying operational fluid pressure to the piston side of fluid cylinder 126 results in the rod of fluid cylinder 126 extending. Extending the rod of fluid cylinder 126 causes stabilizer 272 to move toward ground 284 in the direction indicated by arrow 279 (see FIG. 7).

INDUSTRIAL APPLICABILITY

The arrangement 30 of the present invention allows an operator to control the components of work machine 10 in an ergonomically correct manner and thus makes the operation of work machine 10 convenient for the operator. Moreover, the integration of the control of a number of the components of work machine 10 into main control assembly 32 and auxiliary control assembly 34 decreases the fatigue the operator experiences during operation of the work machine 10 as compared to when a work machine components are controlled by a relatively large number of independent switches and levers. Furthermore, the above described arrangement 30 provides the operator with proportional control over a number of the components of work machine 10 (e.g. the telescopic movement of boom member 16 relative to boom member 14). Providing proportional control increases the operator's ability to precisely control the movements of the components (e.g. boom assembly 12) of work machine 10 during work function performance.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. An arrangement for controlling a work machine which includes (i) a boom and (ii) a coupling mechanism secured to an end of said boom, comprising:

a first control assembly having (i) a first gripping portion and (ii) a first actuator secured to said first gripping portion so that said first actuator can move relative to said first gripping portion, wherein said first control assembly is configured to be operatively coupled to said boom and said coupling mechanism of said work machine such that (i) movement of said first gripping portion in (A) a first direction causes said boom to execute a first movement function, (B) a second direction causes said boom to execute a second movement function, (C) a third direction causes said coupling mechanism to move relative to said boom in a first direction, and (D) a fourth direction causes said coupling mechanism to move relative to said boom in a second direction and (ii) movement of said first actuator relative to said first gripping portion in (A) a first direction causes said boom to execute a third movement function and (B) a second direction causes said boom to execute a fourth movement function.

2. The arrangement of claim 1, wherein said work machine also includes a work implement attached to said coupling mechanism, further comprising:

a second control assembly having a second gripping portion, wherein said second control assembly is configured to be operatively coupled to said work implement such that movement of said second gripping portion causes said work implement to execute a first work function.

3. The arrangement of claim 2, wherein:

said second control assembly includes a second actuator secured to said second gripping portion, said second actuator is positionable between a first position and a second position, when said second actuator is located in said first position movement of said second gripping portion causes said work implement to execute said first work function, and when said second actuator is located in said second position movement of said second gripping portion causes said work implement to execute a second work function.

4. The arrangement of claim 3, wherein:

said second actuator is also positionable in a third position, said arrangement further includes a detent mechanism operatively coupled to said second control assembly such that when (i) said detent mechanism is activated said detent mechanism substantially prevents movement of said second gripping portion and (ii) said detent mechanism is deactivated said second gripping portion is movable, and when said second actuator is (i) located in said third position said detent mechanism is activated and (ii) not located in said third position said detent mechanism is deactivated.

5. The arrangement of claim 2, wherein (i) said coupling mechanism is positionable between a coupled position and a decoupled position and (ii) said second control assembly, further comprises:

a switch operatively coupled to said coupling mechanism, said switch being positionable between an activated position and a deactivated position, wherein locating said switch in said activated position causes said second control assembly to be operatively coupled to said coupling mechanism such that (i) movement of said second gripping portion in a first direction causes said coupling mechanism to be placed in said coupled position and (ii) movement of said second gripping portion in a second direction causes said coupling mechanism to be placed in said decoupled position.

6. The arrangement of claim 2, wherein (i) said work machine includes an auxiliary work implement and (ii) said second control assembly, further comprises:

a switch operatively coupled to said auxiliary work implement, said switch being positionable between an activated position and a deactivated position, wherein locating said switch in said activated position causes said second control assembly to be operatively coupled to said auxiliary work implement such that movement of said second gripping portion actuates said auxiliary work implement so as to perform a work function.

7. The arrangement of claim 6, wherein:

said auxiliary work implement includes a stabilizer secured to a frame of said work machine, said stabilizer being positionable between a retracted position and an extended position, and when said switch is located in said activated position movement of said second gripping portion in (i) a first direction causes said stabilizer to be positioned in said extended position and (ii) a second direction causes said stabilizer to be positioned in said retracted position.

8. The arrangement of claim 1, wherein:

said boom of said work machine is a telescopic boom which is positionable between an extended position and a retracted position, said first actuator includes a knob rotatably secured to said first gripping portion so that said knob can rotate relative to said first gripping portion in said first direction and said second direction, rotation of said knob in said first direction causes said telescopic boom to execute said third movement function such that said telescopic boom is positioned in said extended position, and rotation of said knob in said second direction causes said telescopic boom to execute said fourth movement function such that said telescopic boom is positioned in said retracted position.

9. The arrangement of claim 2, wherein:

said first gripping portion of said first control assembly is mechanically coupled to said second gripping portion of said second control assembly with a parallelagram linkage.

10. A work machine, comprising:

a boom;

a coupling mechanism secured to an end of said boom; and a first control assembly having (i) a first gripping portion and (ii) a first actuator secured to said first gripping portion so that said first actuator can move relative to said first gripping portion, wherein said first control assembly is operatively coupled to said boom and said coupling mechanism such that (i) movement of said first gripping portion in (A) a first direction causes said boom to execute a first movement function, (B) a second direction causes said boom to execute a second movement function, (C) a third direction causes said coupling mechanism to move relative to said boom in a first direction, and (D) a fourth direction causes said coupling mechanism to move relative to said boom in a second direction and (ii) movement of said first actuator relative to said first gripping portion in (A) a first direction causes said boom to execute a third movement function and (B) a second direction causes said boom to execute a fourth movement function.

11. The work machine of claim 10, further comprising:

a work implement attached to said coupling mechanism; and a second control assembly having a second gripping portion, wherein said second control assembly is operatively coupled to said work implement such that movement of said second gripping portion causes said work implement to execute a first work function.

12. The work machine of claim 11, wherein:

said second control assembly includes a second actuator secured to said second gripping portion, said second actuator is positionable between a first position and a second position, when said second actuator is located in said first position movement of said second gripping portion causes said work implement to execute said first work function, and when said second actuator is located in said second position movement of said second gripping portion causes said work implement to execute a second work function.

13. The work machine of claim 12, wherein:

said second actuator is also positionable in a third position, said second control assembly further includes a detent mechanism operable such that when (i) said detent mechanism is activated said detent mechanism substantially prevents movement of said second gripping portion and (ii) said detent mechanism is deactivated said second gripping portion is movable, and when said second actuator is (i) located in said third position said detent mechanism is activated and (ii) not located in said third position said detent mechanism is deactivated.

14. The work machine of claim 11, further comprising:

a switch operatively coupled to said coupling mechanism, said switch being positionable between an activated position and a deactivated position, wherein (i) said coupling mechanism is positionable between a coupled position and a decoupled position and (ii) locating said switch in said activated position causes said second control assembly to be operatively coupled to said coupling mechanism such that (A) movement of said second gripping portion in a first direction causes said coupling mechanism to be placed in said coupled position and (B) movement of said second gripping portion in a second direction causes said coupling mechanism to be placed in said decoupled position.

15. The work machine of claim 11, wherein:

said work machine further includes an auxiliary work implement, said second control assembly further includes a switch operatively coupled to said auxiliary work implement, said switch being positionable between an activated position and a deactivated position, wherein locating said switch in said activated position causes said second control assembly to be operatively coupled to said auxiliary work implement such that movement of said second gripping portion actuates said auxiliary work implement so as to perform a work function.

16. The work machine of claim 15, wherein:

said auxiliary work implement includes a stabilizer secured to a frame of said work machine, said stabilizer being positionable between a retracted position and an extended position, and when said switch is located in said activated position movement of said second gripping portion in (i) a first direction causes said stabilizer to be positioned in said extended position and (ii) a second direction causes said stabilizer to be positioned in said retracted position.

17. The work machine of claim 10, wherein:

said boom of said work machine is a telescopic boom which is positionable between an extended position and a retracted position, said first actuator includes a knob rotatably secured to said first gripping portion so that said knob can rotate relative to said first gripping portion in said first direction and said second direction, rotation of said knob in said first direction causes said telescopic boom to execute said third movement function such that said telescopic boom is positioned in said extended position, and rotation of said knob in said second direction causes said telescopic boom to execute said fourth movement function such that said telescopic boom is positioned in said retracted position.

18. The work machine of claim 11, wherein:

said first gripping portion of said first control assembly is mechanically coupled to said second gripping portion of said second control assembly with a parallelogram linkage.

* * * * *